US005152345A

United States Patent [19]

Yarlott, Jr.

[11] Patent Number: 5,152,345

[45] Date of Patent: Oct. 6, 1992

[54] FIRE EXTINGUISHING TOOL

[76] Inventor: David E. Yarlott, Jr., 117B Julia Martin Dr., Bozeman, Mont. 59715

[21] Appl. No.: 742,374

[22] Filed: Aug. 8, 1991

[51] Int. Cl.[5] ..... A62C 8/04; A62C 13/64; A62C 2/08

[52] U.S. Cl. ..... 169/50; 169/70; 169/71; 169/74; 169/76; 169/48; 81/488; 7/170; 239/289; 239/444; 239/530; 239/557; 239/579

[58] Field of Search ..... 169/70, 50, 52, 30, 169/71, 74, 76, 48, 11; 81/488; 7/170, 167; 239/289, 443, 444, 436, 530, 556, 557, 562, 566, 579

[56] References Cited

U.S. PATENT DOCUMENTS

| | | | |
|---|---|---|---|
| 1,238,583 | 8/1917 | Shving | 169/50 |
| 1,708,553 | 4/1929 | Reams | 169/50 |
| 1,913,786 | 6/1933 | Barron et al. | 169/77 X |
| 1,951,798 | 3/1934 | Lawson et al. | 169/50 |
| 2,044,687 | 6/1936 | Hatten | 169/50 |
| 2,754,624 | 7/1956 | Wester | 169/50 X |

FOREIGN PATENT DOCUMENTS

| | | | |
|---|---|---|---|
| 900938 | 7/1945 | France | 169/50 |
| 1240045 | 7/1960 | France | 169/50 |
| 472711 | 9/1937 | United Kingdom | 169/50 |

*Primary Examiner*—Margaret A. Focarino
*Assistant Examiner*—James M. Kannofsky
*Attorney, Agent, or Firm*—Leon Gilden

[57] ABSTRACT

A fire extinguishing tool is formed as a paddle plate, including top and bottom planar surfaces coextensive relative to one another, with a handle mounted medially and longitudinally aligned relative to the plate to provide a grasping surface for an individual to direct the plate onto flames by smothering such flames preventing oxygen access to the flame area. A modification of the invention includes a central conduit directed through the plate, with a bottom surface of the plate including a matrix of valves directed therethrough, with the handle defining a pneumatic reservoir for directing an inert gas through the bottom surface upon impacting of flames in a fire extinguishing situation.

4 Claims, 4 Drawing Sheets

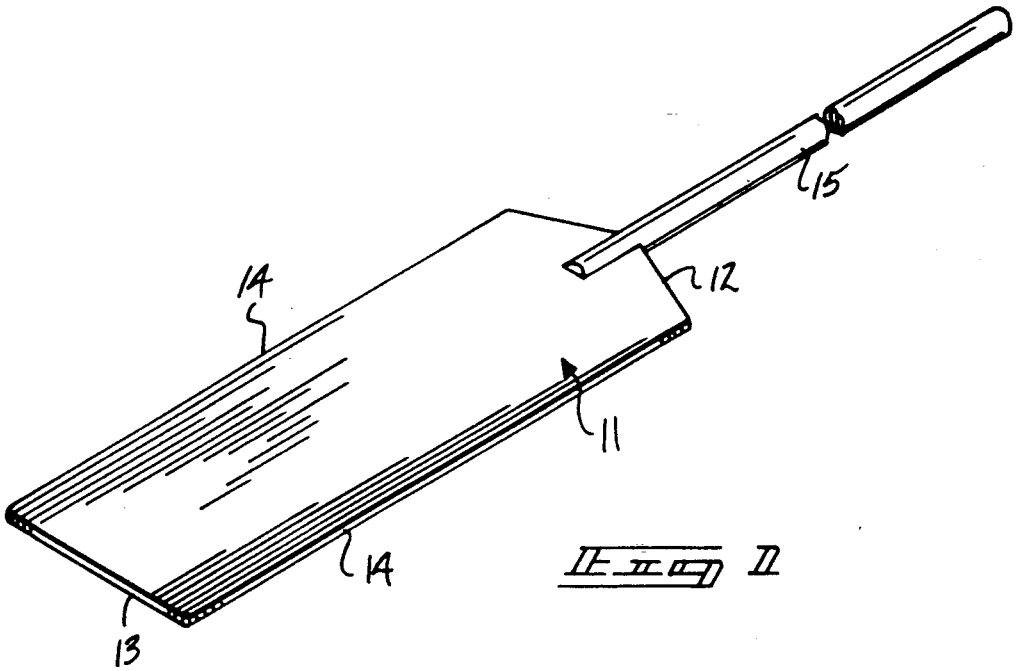
FIG 1
FIG 2
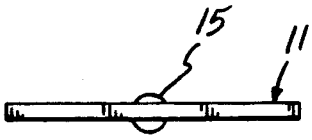
FIG 3
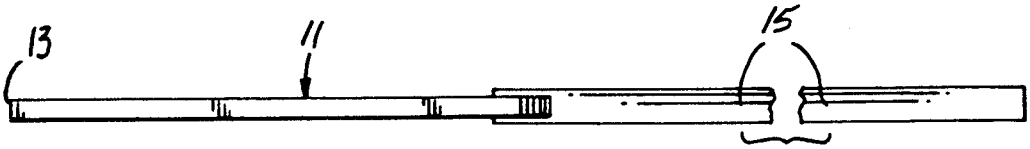

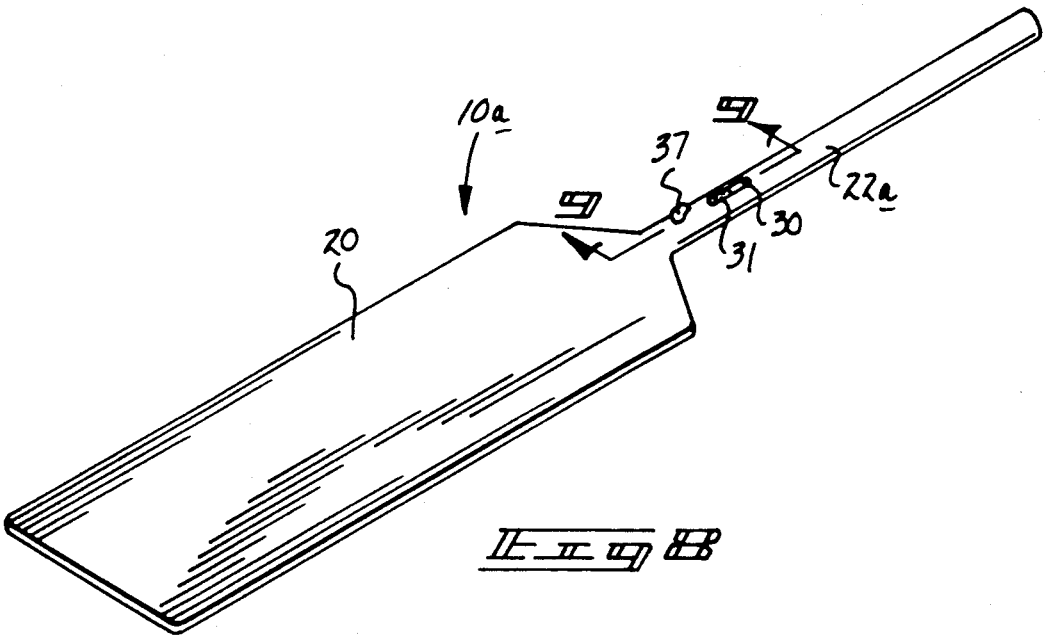
FIG 8B
FIG 9
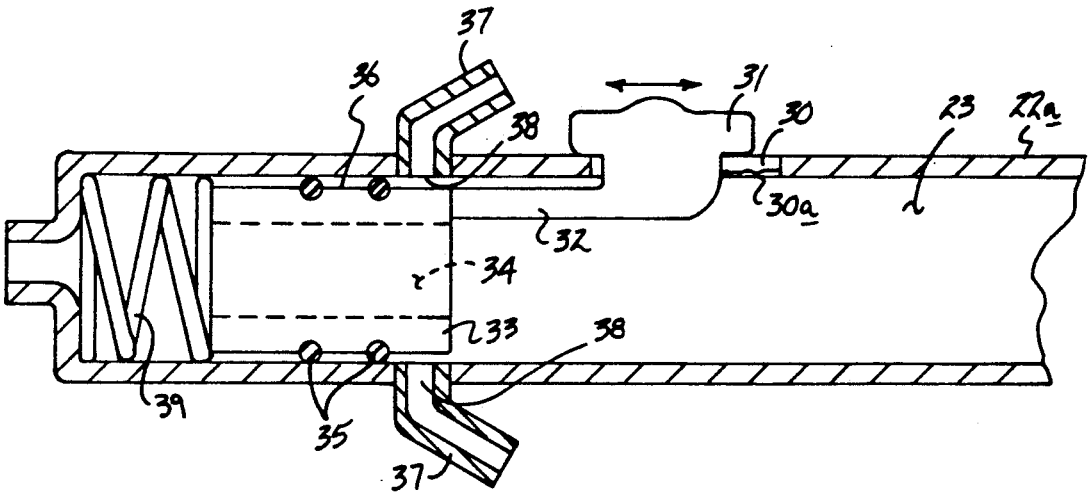

FIRE EXTINGUISHING TOOL

BACKGROUND OF THE INVENTION

1. Field of the Invention

The field of invention relates to fire extinguishing apparatus, and more particularly pertains to a new and improved fire extinguishing tool wherein the same is utilized to impact fire and associated flames preventing oxygen access thereto.

2. Description of the Prior Art

Fire extinguishing apparatus of various types is utilized in the prior art to minimize damage associated with flame structure. A conventional manner of addressing such flames are associated with various liquid and mechanical structure to minimize access of oxygen to the flame and its propagation.

Accordingly, it may be appreciated that there continues to be a need for a new and improved fire extinguishing too as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of fire extinguishing apparatus now present in the prior art, the present invention provides a fire extinguishing tool wherein the same utilizes a planar impact surface positioned forwardly of an associated handle to address flame propagation. As such, the general purpose of the present invention, which will be described subsequently in greater detail, is to provide a new and improved fire extinguishing tool which has all the advantages of the prior art fire extinguishing apparatus and none of the disadvantages.

To attain this, the present invention provides a fire extinguishing tool formed as a paddle plate, including top and bottom planar surfaces coextensive relative to one another, with a handle mounted medially and longitudinally aligned relative to the plate to provide a grasping surface for an individual to impact a fire extinguishing associated flames by smothering such flames preventing oxygen access to the flame area. A modification of the invention includes a central conduit directed through the plate, with a bottom surface of the plate including a matrix of valves directed therethrough, with the handle defining a pneumatic reservoir for directing an inert gas through the bottom surface upon impacting of flames in a fire extinguishing situation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fire extinguishing tool which has all the advantages of the prior art fire extinguishing apparatus and none of the disadvantages.

In is another object of the present invention to provide a new and improved fire extinguishing tool which may be easily and efficiently manufactured and marketed.

It is a further object of the present invention to provide a new and improved fire extinguishing tool which is of a durable and reliable construction.

An even further object of the present invention is to provide a new and improved fire extinguishing tool which is susceptible of a low cost of manufacture with regard to both materials and labor, and which accordingly is then susceptible of low prices of sale to the consuming public, thereby making such fire extinguishing tools economically available to the buying public. Still yet another object of the present invention is to provide a new and improved fire extinguishing tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic end view of the instant invention.

FIG. 3 is an orthographic side view of the instant invention.

FIG. 4 is an isometric illustration of a sleeve utilized by the invention.

FIG. 8 is an isometric illustration of a modified handle structure utilized by the invention.

FIG. 9 is an orthographic view, taken along the lines 9—9 of FIG. 8 in the direction indicated by the arrows.

DESCRIPTION OF THE PREFERRED EMBODIMENT

Figure 11:
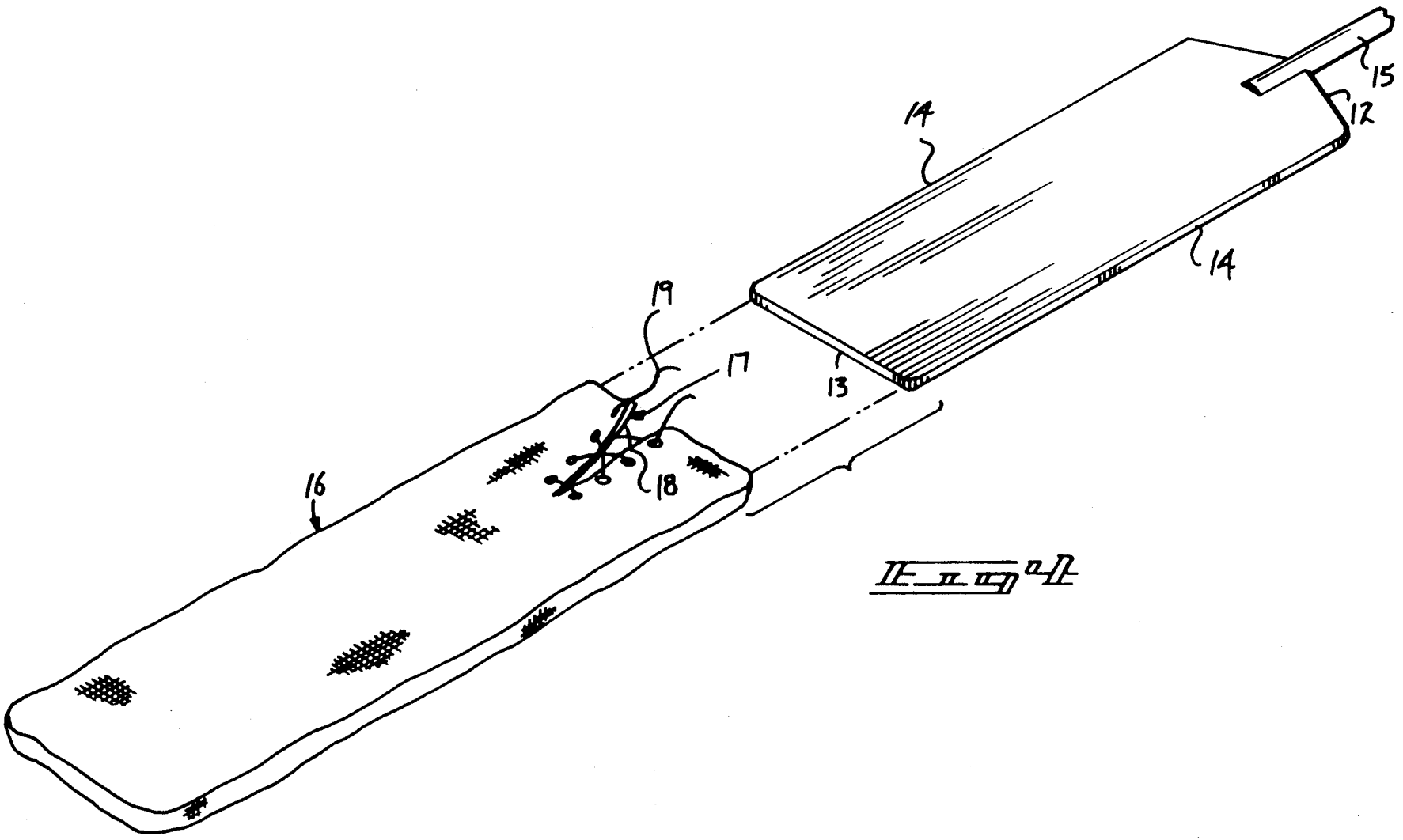
Figure 5:
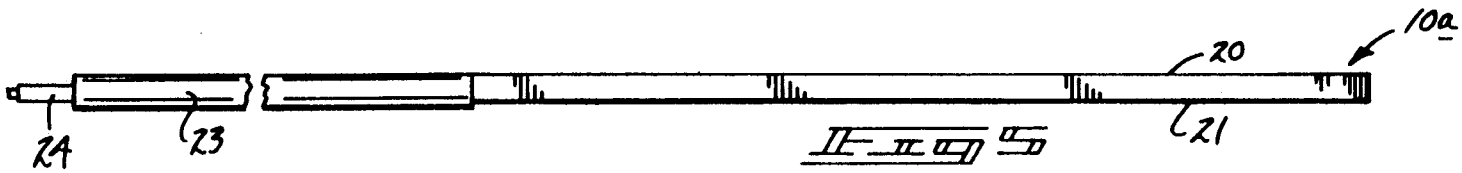
FIG. 5 is an orthographic side view of a modification of the invention.
Figure 6:
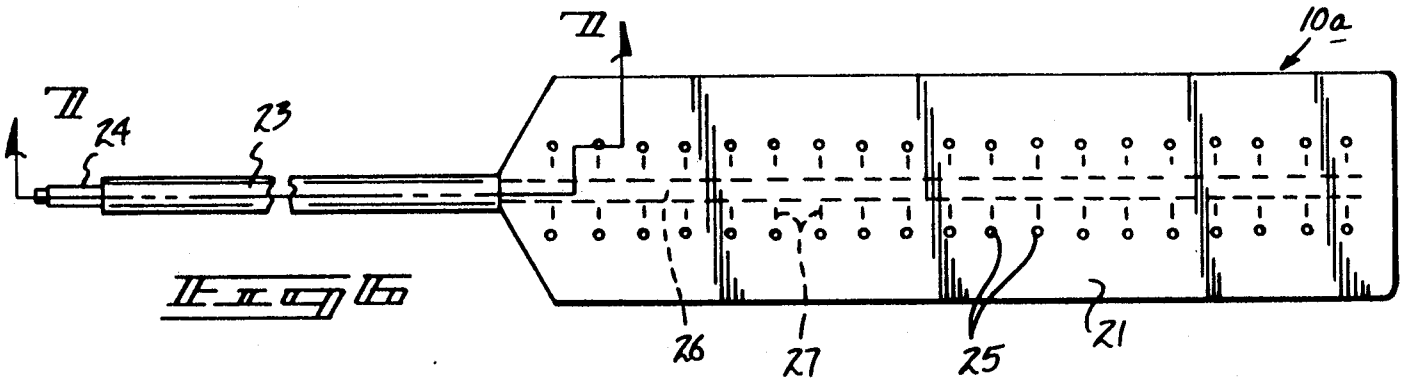
FIG. 6 is an orthographic top view of the modification of the invention.
Figure 7:
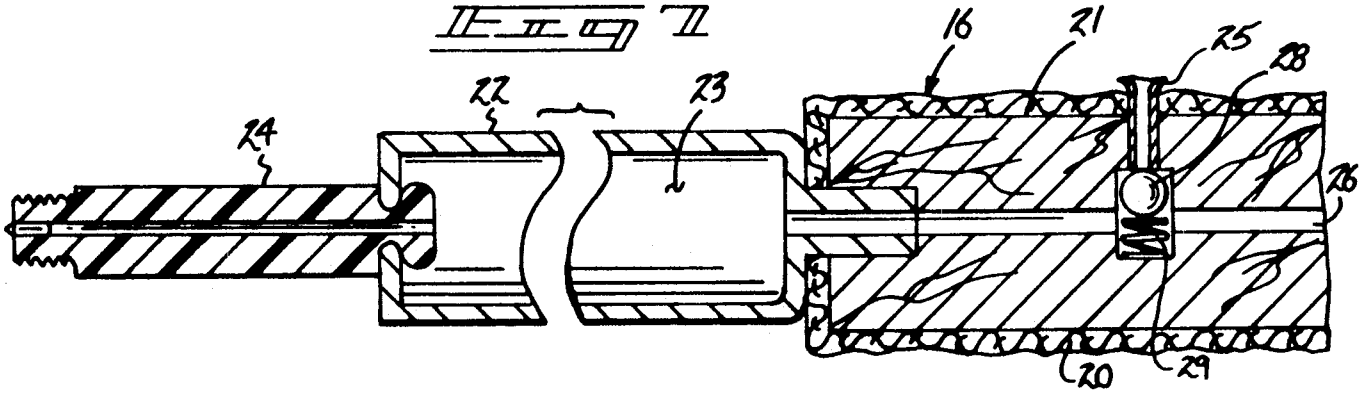
FIG. 7 is an orthographic view, taken along the lines 7—7 of FIG. 6 in the direction indicated by the arrows.

With reference now to the drawings, and in particular to FIGS. 1 to 9 thereof, a new and improved fire extinguishing apparatus embodying the principles and concepts of the present invention and generally designated by the reference numerals 10 and 10*a* will be described.

More specifically, the fire extinguishing tool 10 of the instant invention essentially comprises a paddle plate 11 formed of a rigid construction, including a plate rear edge spaced from a plate forward edge, with plate side edges defining top and bottom coextensive surfaces of the paddle plate 11. The rear edge 12 fixedly mounts a support handle 15, wherein the support handle is longitudinally aligned with the plate 11 and substantially medially of the rear edge 12 substantially parallel to the side edges 14.

FIG. 4 illustrates the plate 11 receiving a fire retardant fabric sheath 16, utilizing such commercially available fabric such as Nomex (R). A sheath entrance opening 17 permits access of the plate 11 therewithin, wherein the sheath 16 defines a cavity complementary to the geometric configuration of the paddle plate 11. A sheath wall split 18 substantially orthogonally oriented relative to the sheath entrance 17 includes a drawstring 19 directed in a serpentine relationship about the split 18 permitting securement of the split and associated sheath about the paddle plate 11.

The modified aspect of the invention, as illustrated in FIGS. 5-9 set forth as a fire extinguishing tool 10*a*, includes a paddle plate top planar surface 20 spaced from a paddle plate bottom planar surface 21. A tubular handle 22 is mounted fixedly and extending rearwardly of the rear edge 12, in a manner as set forth in the description of FIG. 1. The tubular handle 22 includes a pneumatic chamber 23 therewithin, with a fill valve 24 extending rearwardly of a rear end of the handle 22 to permit refilling of the pneumatic chamber 23 with inert gas utilized in fire fighting, such as Halon gas and the like. Plural rows of venting conduits 25 orthogonally project through the bottom surface 21. A central pneumatic conduit 26 is in pneumatic communication with the pneumatic chamber, with each of a plurality of secondary conduits 27 in communication with the conduit 26 and an associated venting conduit 25 through one of a plurality of valve members, each of the valve members including a spherical check ball 28. Each spherical check ball 28 is disposed at an intersection of a secondary conduit 27 and a venting conduit 25, wherein the spherical check ball 28 is normally biased in contiguous communication with an interior end of the venting conduit 25 by a check ball spring 29. Impact with a surface directs the ball rearwardly within a cavity defined at an intersection of the conduit 25 and the secondary conduit 27 to permit projection of the inert gas exteriorly of the venting conduit 25 and onto an associated fire to be extinguished.

A modified handle structure 22*a* is illustrated in FIGS. 8 and 9, wherein a slide member 31 is mounted for reciprocation within a slot 30 formed within the handle 22*a*. The slide member 31 includes a slide member leg 32 fixedly mounted to the slide member 31 at a forward end of the leg, with a rear end of the leg fixedly mounted to a valve block 33. Reciprocation of the slide member 31 accordingly effects reciprocation of the valve block 33 within the pneumatic chamber 23. The valve block 33 is biased to a rearward or first position by a return spring 39. Manual displacement of the valve block to a forward position, or second position, as illustrated in FIG. 9, displaces a plurality of annular "O" ring seals 35 that are positioned on opposed sides of a nozzle conduit entrance 38 of a nozzle conduit 37. The "O" ring seals 35 are spaced apart a predetermined width to define a gap 36, wherein each nozzle conduit entrance 38 is equal to a spacing substantially equal to or less than the predetermined width to normally prevent access of the inert gas through the nozzle conduits 37. The nozzle conduits are directed rearwardly towards the rear terminal end of the handle 23*a* to selectively project inert gas onto an individual's hand to thereby extinguish a flame directed about the individual's hand and further effect a cooling of the hand due to the loss of the inert gas projected from the nozzle conduits 37. A valve block bore 34 coaxially directed through the valve block 33 coextensively therethrough permits directing of the inert gas through the valve block into the associated central conduit 26, in a manner as described above.

It should be further noted that a slide member seal 30*a* mounted within the slot 30 effects sealing closure of an inert gas within the pneumatic chamber during reciprocation and positioning of the slide member relative to the slot 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be proteced by Letters Patent of the United States is as follows:

1. A fire extinguishing tool, comprising, a paddle plate, the paddle plate including a rear edge spaced from a forward edge, and a top planar surface spaced from and parallel to a bottom planar surface, and the rear edge including an elongate handle, the elongate handle is orthogonally oriented relative to the forward edge, and the paddle plate including side edges, with the handle positioned medially and parallel to the side edges and extending rearwardly of the rear edge, and the paddle plate and the handle formed of a rigid material, and a fire retardant fabric sheath, the sheath including a sheath entrance opening, and a sheath cavity, the sheath cavity complementary of an external geometric configuration of the paddle plate, and the sheath entrance opening including a sheath wall split, with the split including a drawstring member directed about the split in a serpentine relationship to effect closure of the split and securement of the sheath about the paddle plate.

2. An apparatus as set forth in claim 1 wherein the bottom surface includes a plurality of venting conduits orthogonally projecting through the bottom surface and the sheath, and the handle including a pneumatic chamber therewithin, and the paddle plate including a central pneumatic conduit in pneumatic communicaton with the pneumatic chamber projecting medially and longitudinally of the paddle plate between the top surface and the bottom surface, and secondary feed conduits in pneumatic communication with the central pneumatic conduit and a plurality of valve members, each of the plurality of valve members defining an intersection between a separate one of the secondary feed conduits and a separate one of the venting conduits.

3. An apparatus as set forth in claim 2 wherein each of the valve members includes a check ball member in biased contiguous communication against an interior end of one of the venting conduits by a check ball spring.

4. An apparatus as set forth in claim 3 including a slot directed through the handle, the slot including a slide member mounted within the slot member, the slide member being sealed within the slot member and being mounted for reciprocation within the slot member, the slide member including a slide member leg projecting into the pneumatic chamber and the leg fixedly mounted to a valve block remote from the slide member, the valve block complementarily received and slidable within the pneumatic chamber, and the valve block including a central bore directed therethrough permitting flow of an inert gas from the pneumatic chamber into the central pneumatic conduit, and the valve block including a valve block spring biasing the valve block in a first rearward position, and the valve block displaceable to a second forward position upon displacement of the slide member within the slot, and a plurality of nozzle conduits in fluid communication with the pneumatic chamber positioned adjacent the valve block, the valve block including a plurality of annular "O" ring seals spaced apart a gap defined by a predetermined width, the "O" ring seals positioned on opposed sides of each nozzle conduit interiorly of the pneumatic chamber when the valve block is in the first position.

* * * * *